United States Patent [19]

Cummins

[11] Patent Number: 4,649,833

[45] Date of Patent: Mar. 17, 1987

[54] SECURITY SYSTEM FOR SAFES

[76] Inventor: Peter S. B. Cummins, 8 Lancelot Street, Mt. Colah, New South Wales 2079, Australia

[21] Appl. No.: 713,908

[22] PCT Filed: Jun. 29, 1984

[86] PCT No.: PCT/AU84/00119

§ 371 Date: Feb. 28, 1985

§ 102(e) Date: Feb. 28, 1985

[87] PCT Pub. No.: WO85/00400

PCT Pub. Date: Jan. 31, 1985

[30] Foreign Application Priority Data

Jun. 30, 1983 [AU] Australia ..... PG0048

[51] Int. Cl.[4] ..... E05G 3/00

[52] U.S. Cl. ..... 109/25; 109/29; 109/59 R; 70/268; 70/278

[58] Field of Search ..... 109/25, 29, 43, 59 R, 109/59 T, 30; 70/267, 268, 337, DIG. 63, 278

[56] References Cited

U.S. PATENT DOCUMENTS

| | | | |
|---|---|---|---|
| 1,743,667 | 1/1930 | Gill | 109/25 |
| 2,140,698 | 12/1938 | Goehring | 70/268 |
| 3,500,771 | 3/1970 | Fischer et al. | 109/29 |
| 3,702,451 | 11/1972 | Hofing | 336/185 |
| 3,730,110 | 5/1973 | Peters | 109/25 |
| 3,876,913 | 4/1975 | Perry | 70/278 |
| 4,033,157 | 7/1977 | Williams | 70/DIG. 63 |
| 4,225,008 | 9/1980 | Colell et al. | 70/337 |

FOREIGN PATENT DOCUMENTS

| | | |
|---|---|---|
| 885245 | 12/1961 | United Kingdom . |
| 1446711 | 8/1976 | United Kingdom . |
| 1450397 | 9/1976 | United Kingdom . |

OTHER PUBLICATIONS

P.C.T. Application 83/02975, Applicant-STENILD, Int. Pub. Date—Sep. 1, 1983.

P.C.T. Application WO,A,83/03872, Applicant CEDERGREN, Publication date—Nov. 10, 1983.

*Primary Examiner*—Gary L. Smith

*Assistant Examiner*—Neill Wilson

*Attorney, Agent, or Firm*—Sandler & Greenblum

[57] ABSTRACT

A safe security system which includes a key operated time delay lock (10) and a separate key switch (9) thereby requiring two individual keys for the opening of the safe, a dye marking device (20) within the safe, a door switch (23), and an electrical interlock circuit operating to activate the marking device if the door switch is operated before the key switch, or if a predetermined sequence of operation of the key switch and time lock is not followed.

16 Claims, 3 Drawing Figures

SECURITY SYSTEM FOR SAFES

This invention relates to security systems for safes and more particularly to an arrangement for indelible marking of currency within the safe when unauthorized entry is attempted.

BACKGROUND ART

To deter unauthorized entry to safes time locks have been installed which prevent withdrawal of the locking bolt before expiry of a predetermined time interval. U.S. Pat. Nos. 3,702,451 (Blizard) and 2,140,698 (Goehring) are examples of such devices which ensure that the door cannot be opened except during a permissive time interval following a time delay period which begins with correct setting of the lock tumblers. In neither instance is any special provision included to guard against forcible entry. For the convenient of authorized users of the safe the time period should not be long, but curtailment of the time interval often only delays burglary and does not prevent it.

Various types of combination, or key, lock and gas or dye alarm devices have also been developed with varying degrees of success. In most instances these devices have attempted to thwart forcible entry of a safe by a burglar. A guard against forcible entry has been independently provided according to U.S. Pat. No. 3,500,771 (Fisher et al) where a dye or gas cartridge is activated by a sprung firing pin when an access door of a cabinet or vending machine is forced. An interlock between a lock switch and an alarm device has also been proposed by U.S. Pat. No. 1,743,667 (Gill). In this instance a reservoir of a marking fluid is disposed at the top of the safe which is sprayed on to the safe contents dependent upon two separate controls, viz. the position of the safe door and in response to a time mechanism. Release of the liquid occurs when the door is opened except during the time that the time mechanism operates which commences upon correct operation of a combination lock.

However, the increasing incidence of safe burglary in banks and other staff-attended establishments has led to coercion of the staff in gaining entry to the safe. In most instances for the safety of the staff, they are advised to cooperate if threatened.

It is the principal objection of this invention to provide a security system for a safe which is secure against forcible entry and includes interlocked procedures in sequential operation for permissive access.

DISCLOSURE OF INVENTION

The invention in one general form consists of a security system for a safe comprising a delayed action time lock permitting unlocking of the safe after a first time period and within a second time period, a switch operable when a door to the safe is opened, a device for dye marking of the safe's contents and being electrically actuated by said door switch, a key operated switch, and an electrical interlock circuit between the key switch, the door switch and the time lock ensuring that said marking device is not actuated if said key switch is operated before said door switch.

BRIEF DESCRIPTION OF DRAWINGS

The invention will be described in more detail with reference to the accompanying drawings, in which.

BEST MODE OF CARRYING OUT THE INVENTION

Figure 1:
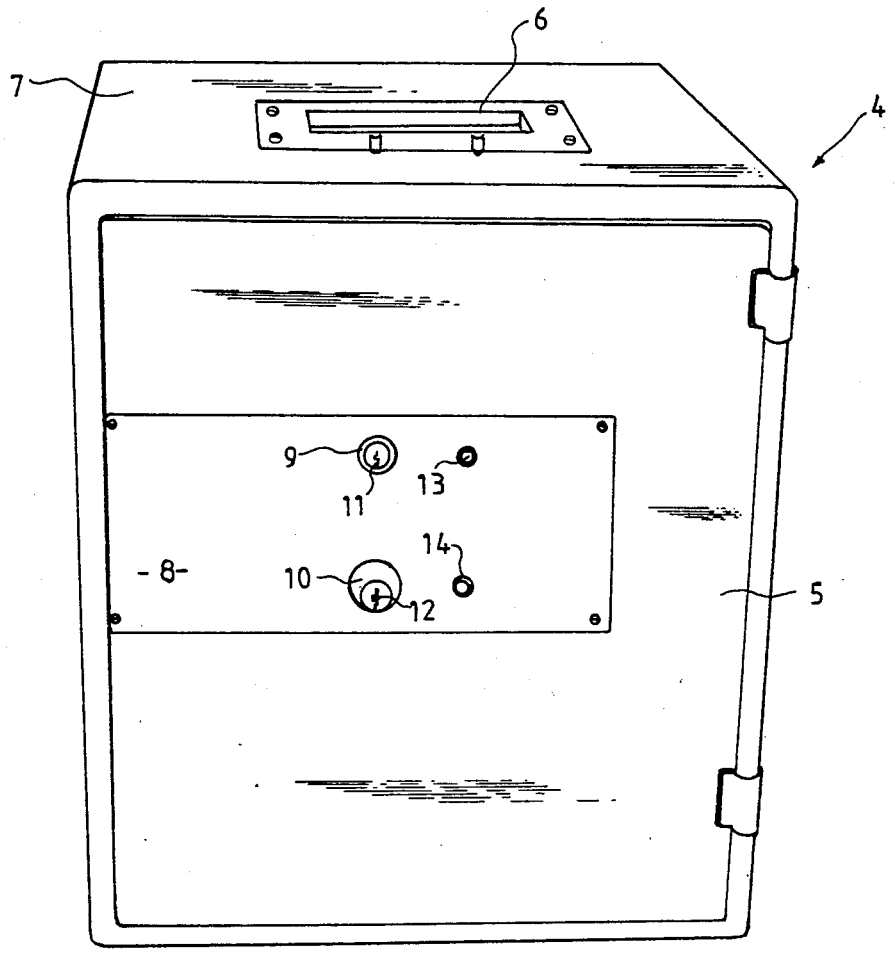
FIG. 1 is a front perspective of a safe incorporating the security system of this invention.

A safe (4) is shown in FIG. 1 which is generally of conventional form, having a front access door (5) and a safety deposit slot (6) at its top (7). Through a face panel (8) upon the door (5) the forward end of two key switches (9) and (10) protrude from the inside of the door. Key switch (9) has a key slot (11) to accept a first security key (not shown) while switch (10) accepts a second security key (not shown) in its key slot (12). Preferably, a further security key is made available for insertion into slot (12) to enable withdrawal of the cylinder lock from switch (10) shoudld a key change be desired. LED visual indicators (13) and (14) are positioned adjacent respective switches (9) and (10).

The operative mechanisms of the key switches (9) and (10) are accessible from the inside of the door (5) (FIG. 2), switch (9) incorporating electrical contacts which are closed with switch operation and connected to terminals (15) and (16), and switch (10) performing the following functions: upon key operation a clockwork timer commences to function and at completion of a predetermined time period first contacts (17) close and at completion of a second time period these contacts open. A second set of contacts (18) close upon key operation and open at completion of the second time period. A locking bolt (19) will be withdrawn to allow the door to be opened, should the key of the time lock be turned during the second time period. An explosive dye marker device (20) incorporating a detonator is mounted upon the inside of the door (5) and activated from the PCB (21). Dry cell batteries (22) are also provided to energize the circuitry, and electrical access to the LED's (13) and (14) is gained from the inside of the door. A door microswitch (23) has contacts which close when the door is open.

Figure 2:
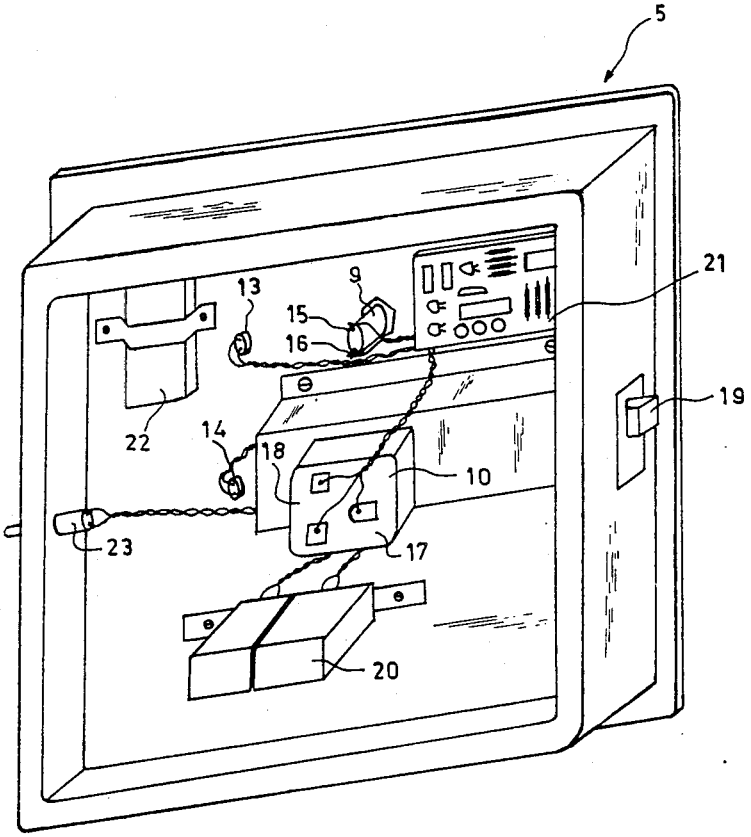
FIG. 2 shows in rear perspective the door of the safe shown in FIG. 1.
Figure 3:
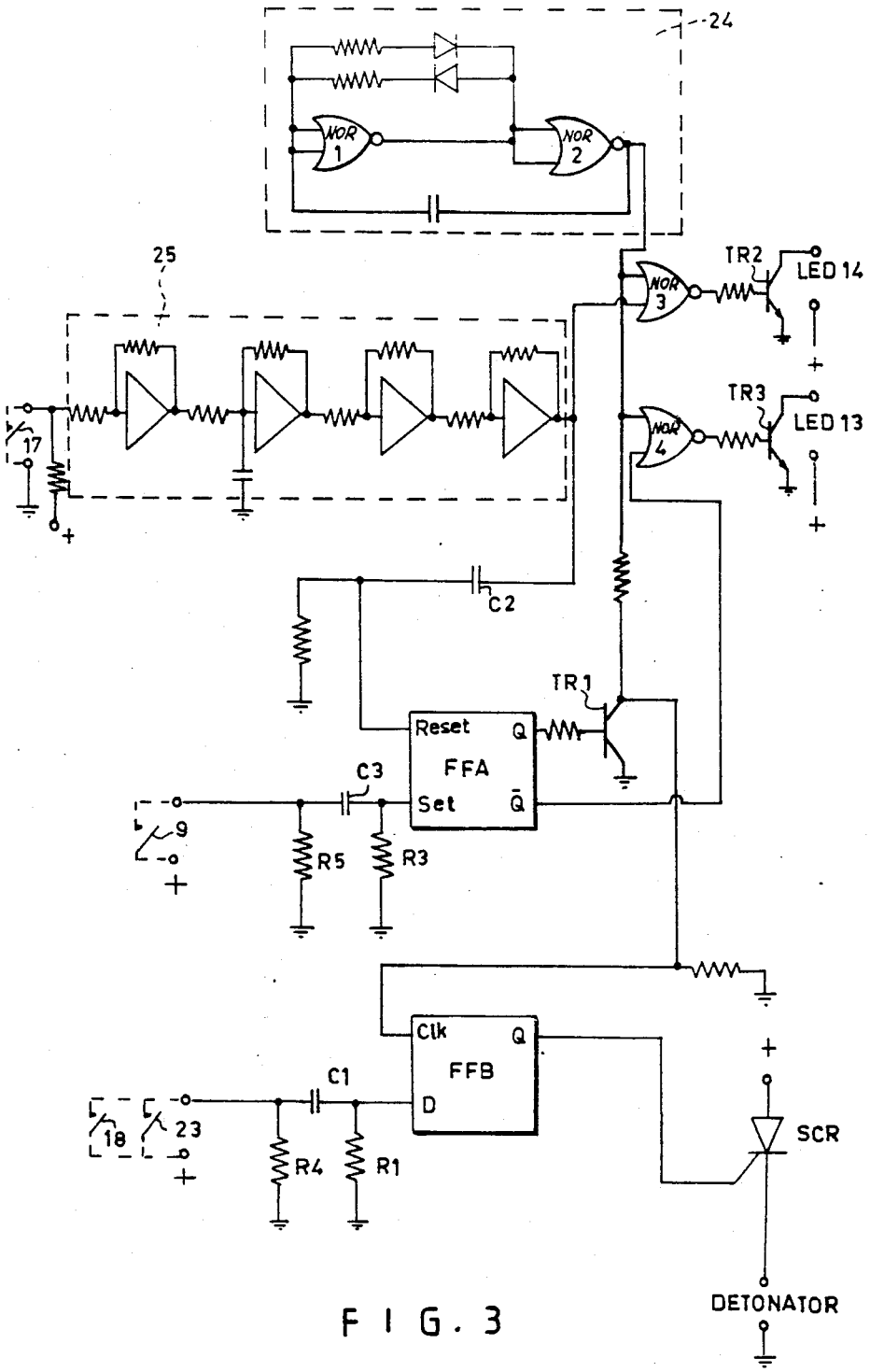
FIG. 3 shows by schematic diagram the electrical interlock circuit of the security system.

Detailed circuitry of the electrical interlock circuit is shown in FIG. 3. The principal components of the circuit comprise a four element NOR gate, two elements, NOR 1 and NOR 2, of which form part of an asymmetrical clock oscillator (24). A four stage Smitt Trigger circuit (25) functions as a de-bouncing circuit to avoid false operation by contacts (17), while a dual flip-flop integrated circuit is connected with section FFA arranged to operate in the direct mode and section FFB arranged as a clocked type D flip-flop. A detonator is fired by current passing through a triggered SCR to disseminate dye from the marking device (20) (FIG. 2). If the key is turned in the time lock (10) to cause its contacts (18) to close, or if the door (5) is opened to effect closure of contacts (23), the input D of section FFB goes high and this is held by the time constant of capacitor C1 and resistor R1 long enough for a clock pulse from oscillator (24) to clock section FFB and send output Q high which will trigger the SCR and cause the detonator to explode.

However, if the key in key switch (9) is turned section FFA of the flip-flop is set at its input to send output Q high which will cause transistor TR1 to conduct and effectively by-pass oscillator (24) pulses from the CLK input to flip-flop section FFB. Thus, if key switch (9) is operated in advance of contacts (18) or (23) closing, no clock input will be applied to section FFB and the detonator will not be activated. Output Q goes low with setting of unit FFA which will derive a high at the output of gate NOR 4. The output current of the gate is applied to the LED (13) via current amplifier transistor TR3. LED (13) will flash due to pulsing from the clock oscillator (24).

When the timer lock switch (10) has completed a first time period as described hereinbefore, contact (17) will close to disconnect battery from the input of the Smitt Trigger (25) so that the output thereof goes low and through gate NOR 3 current is passed via amplifier TR2 to cause LED 14 to flash. With both LED 13 and LED 14 in a flashing mode the operator is alerted to the fact that the security system is in a permissive state for opening of the door 5. This function can then be performed by again turning the key in the time lock (10). Although the first and second time periods of the time lock (10) are selectively predetermined, in one form the first period may include an interval of 20 minutes while the second permissible period may comprise 1 minute. At the conclusion of the second, permissive, period contacts (17) and (18) will open and the interlock circuitry will become reset. Resetting occurs due to the output of the Trigger (25) going high which will firstly extinguish LED 14 and secondly reset flip-flop section FFA through capacitors C2 which will cause output Q to go high and extinguish LED 13. Resistor R4 establishes a discharge time constant of capacitor C1 to ensure that contacts (18) and (23) are provided with added time for opening after the circuit has been reset. Capacitor C3 and resistors R3 and R5 are provided at the input of section FFA of flip-flop for similar purposes to that described in respect of section FFB.

It will now be appreciated that in order to avoid dye marking of the contents of the safe (4) a predetermined sequence of operations in respect of the security system must be adhered to. It is envisaged that the two keys required for opening of the door (5) will be in the possession of different personnel, for example one key may be retained by a member of the bank staff while the other is possessed by a security guard or even at a location remote from the premises on which the safe (4) is installed. The necessary sequence of operations involves turning of the key in the key switch (9) with subsequent turning of key in the time lock (10), and subsequently while both LED 13 and LED 14 are flashing the key of the time lock may again be turned to effect withdrawal of the locking bolt on the door (5).

Whereas a preferred embodiment has been described in the foregoing passages it should be understood that other forms, refinements and modifications are possible within the scope of this invention.

I claim:

1. A security system for a safe comprising:

(a) a delayed action time lock for locking and unlocking the door of said safe;

(b) a first key switch, wherein a first operation of said first key switch activates said time lock, wherein a second operation of said first key switch opens said time lock in the event said second operation of said first key switch occurs after a first period of time since said first operation of said first key switch and within a second period of time;

(c) a second key switch; and (d) a dye marking device for marking the contents of said safe in response to operating said first key switch before operating said second key switch, wherein said dye marking device is inactivated when said second key switch is operated before said first key switch.

2. A security system for a safe comprising a delayed action time lock permitting unlocking of the safe after a first time period and within a second time period, a switch operable when a door to the safe is opened, a device for dye marking of the safe's contents and being electrically actuated by said door switch, a key operated switch, and an electrical interlock circuit between the key swith, the door switch and the time lock ensuring that said marking device is not activated if said key switch is operated before said door switch.

3. A security system according to claim 2, wherein said marking device is actuated also by said time lock, and said interlock circuit ensures that said marking device is not actuated if said key switch is operated before said time lock.

4. A security system according to claim 3, wherein said marking device is actuated by an electrical circuit including a network comprising parallel connected electrical contacts corresponding respectively to said time lock and to said door switch, and an electrical switching device controlled by said key switch for connection and disconnection of said network to said marking device.

5. A security system according to any one of the preceding claims, wherein said time lock is key operated.

6. A security system according to claim 2, wherein said electrical interlock circuit also includes individual visual devices indicating that said key switch has been operated and indicating that a permissive period exists for opening of the safe door.

7. A security system according to claim 2, wherein said electrical interlock circuit is energized by a battery and includes a clock oscillator for actuation of said marking device.

8. A security system according to claim 7, wherein said time lock, said door lock, said key switch, said marking device, said electrical interlock circuit and said battery are mounted upon said door internally of said safe.

9. A security system according to claim 2 wherein said door switch is closed automatically in response to opening of said door.

10. A security system according to claim 2 further comprising a locking bolt selectively locking said safe, wherein said delayed action time lock comprises another key operated switch for opening said locking bolt only after said first period of time and within said second period of time.

11. A security system according to claim 10 wherein said door switch, said time lock, said key switches, and said dye marking device together comprise means for activating said marking device unless said key operated switch is operated before said another key operated switch of said delayed action time lock is operated.

12. A method of opening a locked safe equipped with a security system without marking the contents thereof with a dye from a dye marking device comprising the steps of:

(a) operating a first switch;

(b) operating a second switch connected to a locking bolt for locking and unlocking the door of said safe;

(c) waiting a predetermined period of time after operating said second switch;

(d) again operating said second switch after said predetermined period of time and within a second period of time; and (e) opening said door.

13. The method defined by claim 12 wherein step (d) further comprises the steps of:

operating said second switch only when two visual indicators of said security system emit a visual signal, wherein said two visual indicators emit said visual signal after said predetermined period of time and within said second period of time.

14. The method defined by claim 13 wherein step (a) comprises the step of operating said first switch with a key, wherein step (b) comprises the step of operating said second switch with a key.

15. The method defined by claim 14 further comprising the step of operating a door switch in response to opening said door, wherein said door switch activates the marking device if a said door switch is operated before said first switch is operated.

16. The method defined by claim 15 in combination with a method for operating said security system comprising the steps of:

activating a time lock by operating said first switch;

locking said locking bolt against opening by said second switch until after said first period of time;

permitting said locking bolt to be opened by said second switch within said second period of time;

electrically activating said dye marking device with said door switch and with said second switch in the event one of said door switch and said second switch are operated before said first switch is operated.

* * * * *